US010612841B2

(12) United States Patent
Kim

(10) Patent No.: US 10,612,841 B2
(45) **Date of Patent: *Apr. 7, 2020**

(54) SMALL-SCALE HYDROGEN LIQUEFACTION SYSTEM EQUIPPED WITH CRYOCOOLER

(71) Applicant: Hylium Industries, Inc., Seoul (KR)

(72) Inventor: Seo Young Kim, Seoul (KR)

(73) Assignee: HYLIUM INDUSTRIES, INC (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,205

(22) Filed: Apr. 16, 2019

(65) Prior Publication Data

US 2019/0242644 A1 Aug. 8, 2019

Related U.S. Application Data

(63) Continuation-in-part of application No. 15/404,114, filed on Jan. 11, 2017, now Pat. No. 10,309,718.

(30) Foreign Application Priority Data

Jan. 20, 2016 (KR) ..... 10-2016-0007292
Mar. 23, 2016 (KR) ..... 10-2016-0034870

(51) Int. Cl.
*F25J 1/02* (2006.01)
*F25J 1/00* (2006.01)

(52) U.S. Cl.
CPC ..... *F25J 1/0225* (2013.01); *F25J 1/001* (2013.01); *F25J 1/0072* (2013.01); *F25J 1/0227* (2013.01); *F25J 1/0261* (2013.01); *F25J 1/0262* (2013.01); *F25J 1/0271* (2013.01); *F25J 2270/908* (2013.01); *F25J 2270/91* (2013.01)

(58) Field of Classification Search
CPC F25J 1/0225; F25J 1/0227; F25J 1/001; F25J 2215/30; F25J 2270/912
See application file for complete search history.

(56) References Cited

U.S. PATENT DOCUMENTS 3,237,416 A * 3/1966 Seddon ..... F25J 1/0007 62/606
10,309,718 B2 * 6/2019 Kim ..... F25J 1/0225
(Continued)

FOREIGN PATENT DOCUMENTS

JP 2005083588 A 3/2005
JP 2007205667 A 8/2007
(Continued)

*Primary Examiner* — Brian M King
(74) *Attorney, Agent, or Firm* — Mendelsohn Dunleavy, P.C.

(57) ABSTRACT

Disclosed is a small-scale hydrogen liquefaction system using cryocoolers. The system includes: a gas supply line to supply a gaseous hydrogen; n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 2; n heat exchangers each attached to a cold head of each of the n cryocoolers; and a low-temperature chamber providing an accommodation space to accommodate the n cryocoolers therein.

14 Claims, 11 Drawing Sheets

(56) References Cited

U.S. PATENT DOCUMENTS

| | | | | |
|---|---|---|---|---|
| 2013/0047632 | A1* | 2/2013 | Rillo Millan | F25B 9/00 62/6 |
| 2014/0053598 | A1 | 2/2014 | Ishimaru et al. | |
| 2014/0069116 | A1 | 3/2014 | Durand | |
| 2015/0153100 | A1* | 6/2015 | Zia | F25J 1/0022 62/6 |
| 2015/0300719 | A1* | 10/2015 | Strickland | F28D 7/106 62/62 |

FOREIGN PATENT DOCUMENTS

| | | | |
|---|---|---|---|
| KR | 1020100130657 | A | 12/2010 |
| KR | 101458098 | B1 | 10/2014 |

* cited by examiner

SMALL-SCALE HYDROGEN LIQUEFACTION SYSTEM EQUIPPED WITH CRYOCOOLER

CROSS REFERENCE TO RELATED APPLICATION

This application is a continuation-in-part of application Ser. No. 15/404,114, filed Jan. 11, 2017, which claims priority to Korean Patent Application Nos. 10-2016-0007292 and 10-2016-0034870, filed Jan. 20, 2016 and Mar. 23, 2016 respectively, and the entire contents of all of these patent applications are incorporated herein for all purposes by this reference.

BACKGROUND OF THE INVENTION

Field of the Invention

The present invention relates to a small-scale hydrogen liquefaction system equipped with a cryocooler. More particularly, the present invention relates to a small-scale hydrogen liquefaction system equipped with cryocoolers to increase a liquefaction rate.

Description of the Related Art

Liquid hydrogen is used as a fuel. It is 10 times lighter than fossil fuels and is thus popular in the aerospace industry. That is, it is favorably used as a propellant for rockets, unmanned aerial vehicles (UAV's), etc. Furthermore, as vehicles that use hydrogen fuel in their internal combustion engine have been recently commercialized, there is a dramatic increase in the demand for liquid hydrogen as fuel.

This trend is boosting domestic demand for liquid hydrogen in fundamental research laboratories. Thus, supply of liquid hydrogen obtained through small-scale liquefaction can be an impetus for the development of relevant technologies and market expansion.

Meanwhile, a hydrogen liquefaction temperature is about 20.3 K. That is, hydrogen is liquefied at cryogenic temperatures unlike general materials. To obtain liquid hydrogen, various technologies including cryogenic engineering, thermodynamics, heat transfer, etc. are required. A typical large-scale hydrogen liquefaction plant involves a Brayton cycle or a Claude cycle, both of which need to use a variety of equipment such as a compressor, a heat exchanger, and a cryogenic turbine. Therefore, it is difficult to adopt such a cycle in a small-scale liquefaction process.

Therefore, different approaches are required to realize a small-scale hydrogen liquefaction system.

As a related art, Korean Patent No. 10-1585825 discloses a hydrogen liquefaction apparatus in which a heat pipe has a double pipe structure and a pre-cooling pipe equipped with an ortho-para converter is arranged in a double-piped portion filled with solid nitrogen (SN2). In the apparatus, gaseous hydrogen (GH2) sequentially undergoes pre-cooling and ortho-para conversion by passing through the pre-cooling pipe and the ortho-para converter and then comes into contact with an evaporator of the heat pipe, thereby being liquefied. This apparatus reduces initial loads of a cryogenic cooler in this way.

A conventional hydrogen liquefaction apparatus using a cryocooler has a disadvantage of small liquefaction capacity because it uses only a single pre-cooling pipe and a single cryocooler to liquefy hydrogen. Therefore, the conventional hydrogen liquefaction apparatus cannot meet an increasing demand for liquid hydrogen and cannot satisfy sufficient productivity and economic feasibility.

For this reason, development of a hydrogen liquefaction technology that can lower initial investment costs, simplify the structure of parts, guarantee safety, and increase a liquefaction rate is required.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the prior art, and an object of the present invention is to provide a small-scale hydrogen liquefaction system that includes multiple cryocoolers, thereby increasing a producing rate of liquid hydrogen while having a simple structure.

In order to accomplish the objects, according to one aspect, there is provided a small-scale hydrogen liquefaction system employing multiple cryocoolers to liquefy gaseous hydrogen through multiple cooling stages, the system comprising: a gas supply line to supply a gaseous hydrogen; n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 2; n heat exchangers each attached to a cold head of each of the n cryocoolers; and a low-temperature chamber providing an accommodation space to accommodate the n cryocoolers therein.

The small-scale hydrogen liquefaction system may further include a pre-cooling heat exchanger for pre-cooling the gaseous hydrogen supplied from the gas supply line, using liquid nitrogen, wherein the pre-cooling heat exchanger is connected between the gas supply line and the n cryocoolers and is configured to provide the pre-cooled gaseous hydrogen to each of the n cryocoolers.

The small-scale hydrogen liquefaction system may further include m cryocoolers having the first cryocooler to m-th cryocooler and connected between the gas supply line and the n cryocoolers, wherein m is a natural number equal to or greater than 1, wherein the m cryocoolers are sequentially connected in series from the first cryocooler to the m-th cryocooler and configured such that the gaseous hydrogen supplied from the gas supply line sequentially flows through the first cryocooler to the m-th cryocooler and the gaseous hydrogen outputted from the m-th cryocooler is divided and supplied to each of the n cryocoolers.

In the small-scale hydrogen liquefaction system, each of the n cryocoolers may be a single-stage cryocooler having one expansion stage.

In the small-scale hydrogen liquefaction system, cold heads of the n cryocoolers may be equipped with respective heat exchangers, and the heat exchangers attached to the respective cold heads each may be a tube-cylinder heat exchanger (TCHX) in which a tube through which gaseous hydrogen flows is wound around an outer surface of a cylinder.

In the small-scale hydrogen liquefaction system, the low-temperature chamber may include: an outer chamber providing an accommodation space to accommodate the pre-cooling heat exchanger and the n cryocoolers therein; a liquefaction chamber installed in the outer chamber and containing liquid hydrogen liquefied by the condensation plates; and an upper plate installed at an upper end of the outer chamber and fixing the pre-cooling heat exchanger and the n cryocoolers.

In the low-temperature chamber of the small-scale hydrogen liquefaction system, a gap between the outer chamber and the liquefaction chamber may be filled with liquid nitrogen functioning to hinder intrusion of radiant heat.

In the small-scale hydrogen liquefaction system, the upper plate may be designed to be used without any change whether the number of cryocoolers is two or three, and the upper plate may be provided with an exhaust gas hole, a pre-cooling gaseous hydrogen gas supply hole, and a cryocooler mounting unit.

In the small-scale hydrogen liquefaction system, the pre-cooling heat exchanger may be structured such that a coil-shaped tube is dipped in a cylindrical chamber; and the pre-cooling heat exchanger may be directly attached to the upper plate of the outer chamber or attached via flanges provided to an upper end and a lower end of the pre-cooling heat exchanger such that the pre-cooling heat exchanger is exposed on the upper plate.

The small-scale hydrogen liquefaction system may further include: a vertical bar installed at a lower end of at least one of the n cryocoolers; and a plurality of temperature sensors arranged at regular intervals on a surface of the vertical bar to detect a level of liquid hydrogen in the liquefaction chamber and to determine stop timing of the hydrogen liquefaction system.

According to other aspect, there is provided a small-scale hydrogen liquefaction system employing multiple cryocoolers to liquefy gaseous hydrogen through multiple cooling stages, the system comprising: a gas supply line to supply a gaseous hydrogen; n cryocoolers each connected to the gas supply line to be connected in parallel with each other and configured such that the gaseous hydrogen supplied from the gas supply line is divided into n portions, and the n portions flow through the n cryocoolers, respectively and are cooled to a liquefaction temperature, wherein n is a natural number equal to or greater than 2; n condensation plates arranged to be in contact with the n cryocoolers, respectively, to liquefy the gaseous hydrogen, the n portions of which are cooled to the liquefaction temperature by the n cryocoolers, respectively; and a low-temperature chamber providing an accommodation space to accommodate the n cryocoolers therein.

The small-scale hydrogen liquefaction system may further include: a pre-cooling heat exchanger for pre-cooling the gaseous hydrogen supplied from the gas supply line, using liquid nitrogen, wherein the pre-cooling heat exchanger is connected between the gas supply line and the n cryocoolers and is configured to provide the pre-cooled gaseous hydrogen to each of the n cryocoolers.

The small-scale hydrogen liquefaction system may further include m cryocoolers having the first cryocooler to m-th cryocooler and connected between the gas supply line and the n cryocoolers, wherein m is a natural number equal to or greater than 1, wherein the m cryocoolers are sequentially connected in series from the first cryocooler to the m-th cryocooler and configured such that the gaseous hydrogen supplied from the gas supply line sequentially flows through the first cryocooler to the m-th cryocooler and the gaseous hydrogen outputted from the m-th cryocooler is divided and supplied to each of the n cryocoolers.

The small-scale hydrogen liquefaction system may further include m heat exchangers each attached to a cold head of each of the first cryocooler to the m-th cryocooler.

In the small-scale hydrogen liquefaction system cold heads of the m cryocoolers may be equipped with respective heat exchangers, and the heat exchangers attached to the respective cold heads each may be a tube-cylinder heat exchanger (TCHX) in which a tube through which gaseous hydrogen flows is wound around an outer surface of a cylinder.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
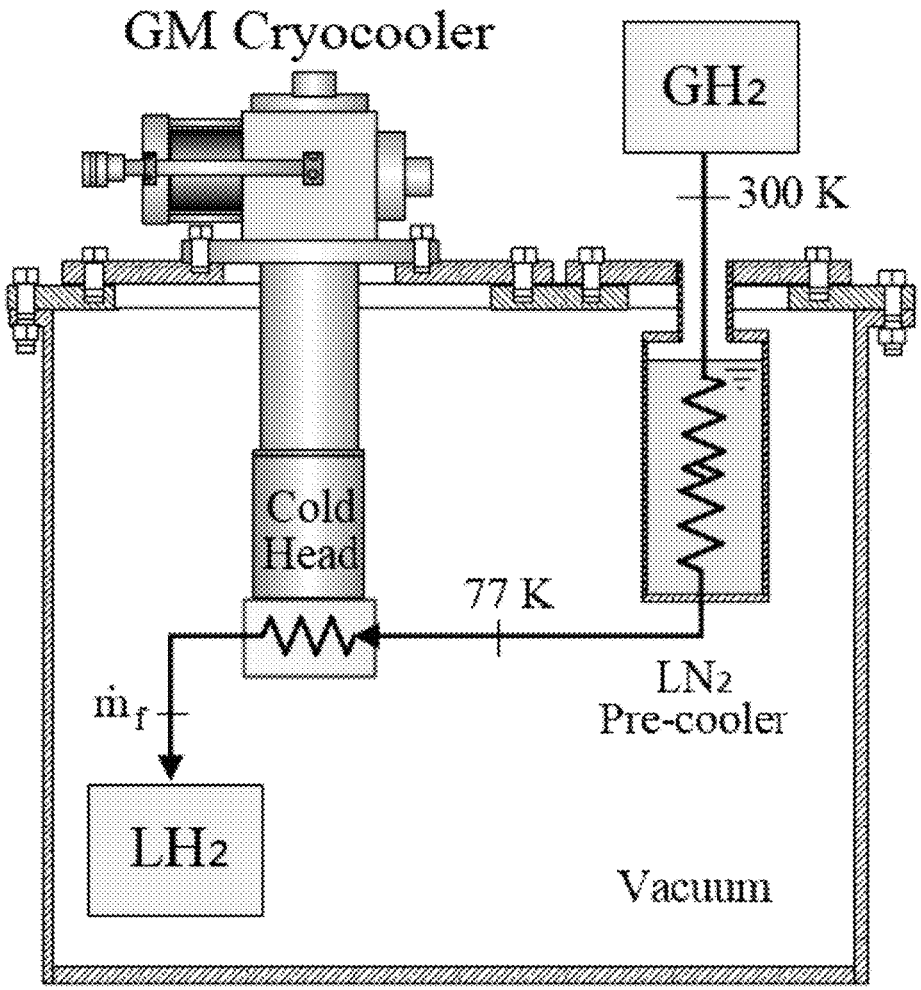
FIG. 1 is a diagram illustrating a hydrogen liquefaction system including a single-stage cryocooler.
Figure 2:
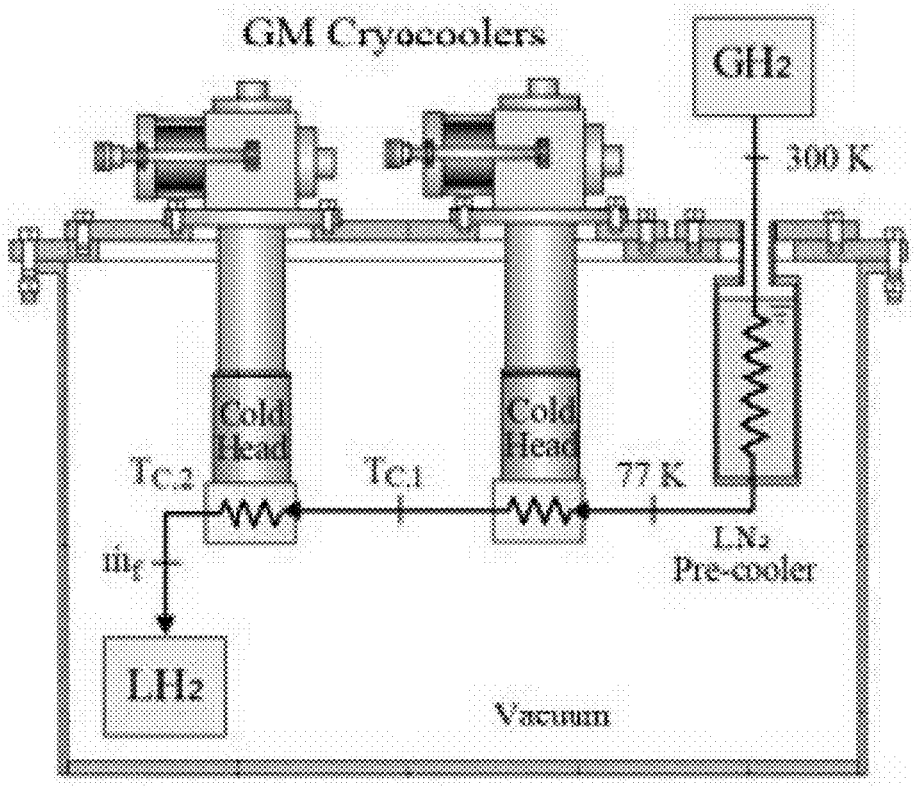
FIG. 2 is a diagram illustrating a hydrogen liquefaction system including two single-stage cryocoolers connected in series with each other.
Figure 3:
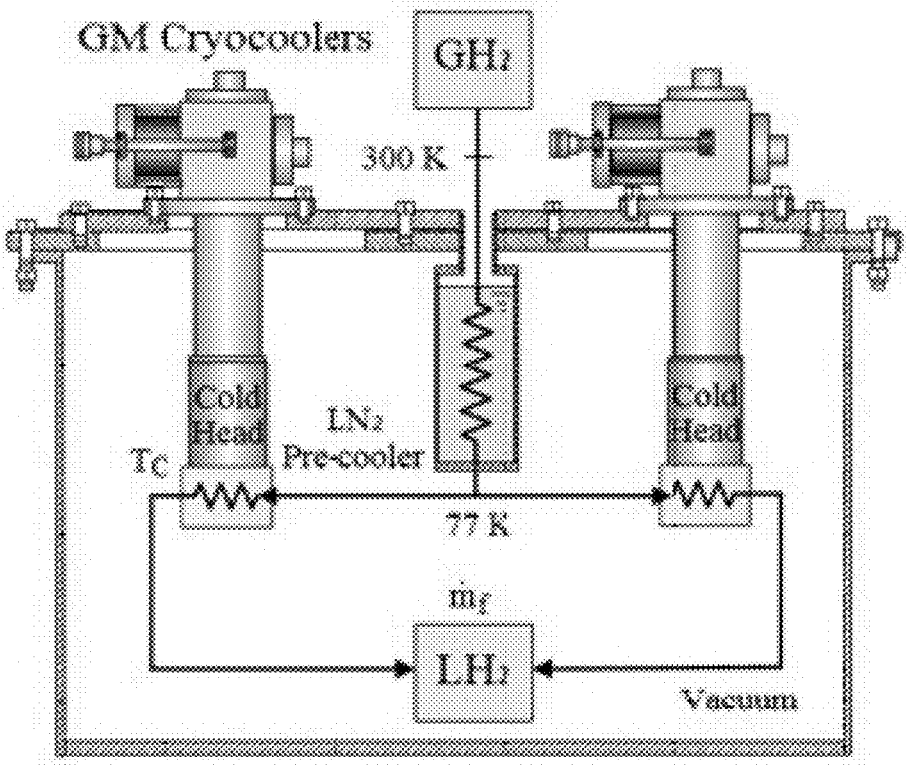
FIG. 3 is a diagram illustrating a hydrogen liquefaction system including two single-stage cryocoolers connected in parallel with each other.
Figure 4:
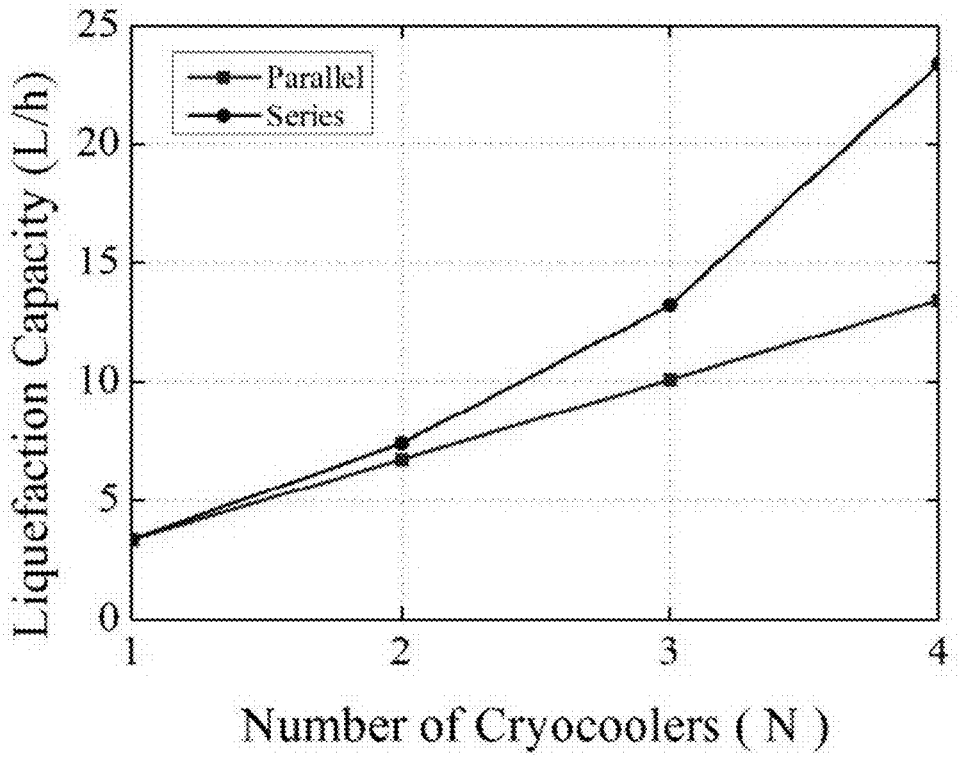
FIG. 4 is a comparative graph comparing liquefaction capacities of a hydrogen liquefaction system having a series connection structure and a hydrogen liquefaction system having a parallel connection structure, the liquefaction capacities varying according to the number of cryocoolers included in the respective hydrogen liquefaction systems.

FIG. 1 is a diagram illustrating a hydrogen liquefaction system including a single-stage cryocooler; FIG. 2 is a diagram illustrating a hydrogen liquefaction system including two single-stage cryocoolers connected in series with each other; FIG. 3 is a diagram illustrating a hydrogen liquefaction system including two single-stage cryocoolers connected in parallel with each other; FIG. 4 is a comparative graph comparing liquefaction capacities of a hydrogen liquefaction system having a series connection structure and a hydrogen liquefaction system having a parallel connection structure, the liquefaction capacities varying according to the number of cryocoolers included in the respective hydrogen liquefaction systems; and FIG. 5 is a diagram illustrating a small-scale hydrogen liquefaction system according to a first embodiment of the present invention, in which two cryocoolers and a condensation plate are included.

Figure 5:
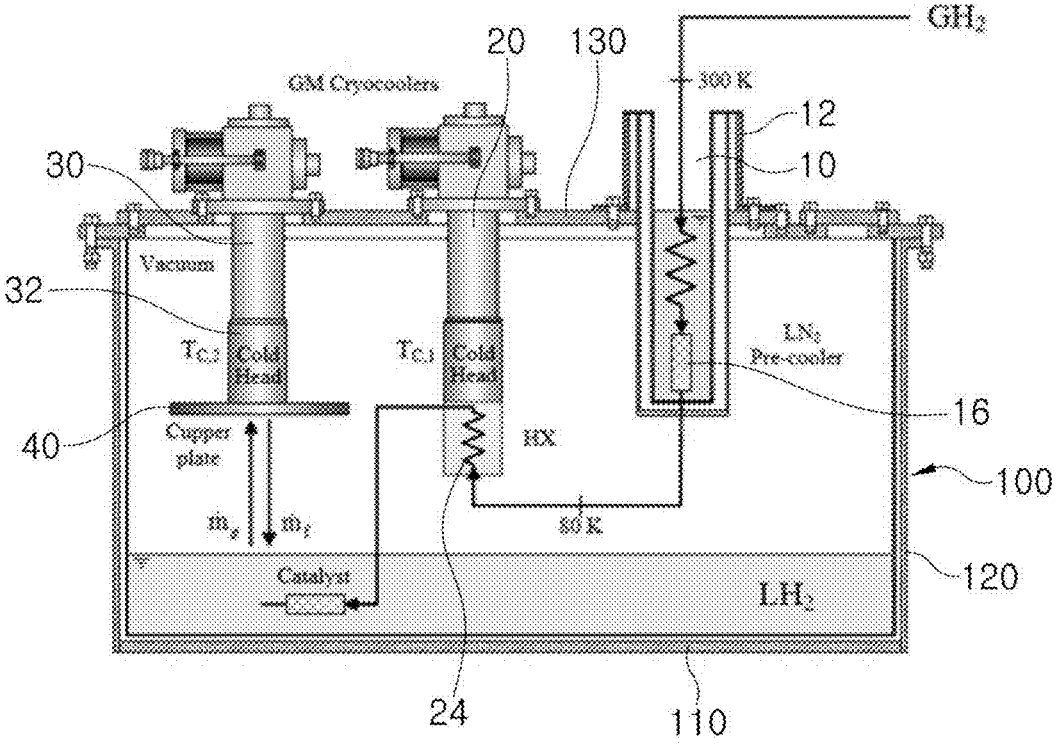
FIG. 5 is a diagram illustrating a small-scale hydrogen liquefaction system according to a first embodiment of the present invention, in which two cryocoolers and a condensation plate are included.

According to a first embodiment of the present invention, a small-scale hydrogen liquefaction system roughly includes a pre-cooling heat exchanger 10, two cryocoolers 20 and 30, a condensation plate 40, and a low-temperature chamber 100 as illustrated in FIG. 5.

In the present embodiment, the cryocoolers 20 and 30 each may be a single-stage cryocooler having one expansion stage.

A typical cryocooler is similar to a Stirling cooler but is equipped with a displacer instead of an expander. A displacer is superior to an expander in terms of mechanical reliability because it has a small pressure difference between respective ends thereof. For this reason, cryocoolers have been put to practical use. Therefore, currently in the fields in which cryogenic cooling is required, cryocoolers are mostly used. On the other hand, a cryocooler has lower cooling efficiency than a Stirling cooler because entropy is created during operation of a displacer. Cryocoolers are classified into single-stage cryocoolers and double-stage cryocoolers according to the number of expansion stages. To improve reliability of pre-designing, any one type of cryocooler that is considered to be more advantageous is selected from among the single-stage cryocooler and the double-stage cryocooler, and actual performance (not ideal performance) of the cryocoolers is considered in the process of pre-designing.

In a double-stage cryocooler, two expansions are consecutively performed in one cryocooler. Therefore, a double-stage cryocooler is advantageous over a single-stage cryocooler in terms of reaching cryogenic temperatures.

However, since there is a large difference in liquefaction capacity between two expansion stages, the overall liquefaction capacity of the double-stage cryocooler is not high. Thus, use of multiple double-stage cryocoolers does not have merit.

On the other hand, since a single-stage cryocooler has only one expansion stage, the single-stage cryocooler is disadvantageous over a double-stage cryocooler in terms of reaching cryogenic temperatures. However, in the case of using multiple single-stage cryocoolers, various constructions can be designed. Therefore, use of multiple single-stage cryocoolers has merit. According to an analysis conducted by the applicant of the present invention, a single-stage cryocooler has a liquefaction capacity two times larger than the liquefaction capacity (1.48 L/h) of a double-stage cryocooler. Therefore, as illustrated in FIG. 1, it is better to use a single-stage cryocoolers than a double-stage cryocooler.

Although a single-stage cryocooler exhibits higher liquefaction performance than a double-stage cryocooler, even the single-stage cryocooler falls short of a target liquefaction capacity of 10 L/h.

For this reason, the inventor of the present invention has conceived the idea of using multiple single-stage cryocoolers to increase liquefaction capacity. Thus, as illustrated in FIGS. 2 and 3, the inventor suggests a series connection combination in which single-stage cryocoolers are connected in series with each other and a parallel connection combination in which single-stage cryocoolers are connected in parallel with each other.

Liquefaction capacities of the series connection combination and the parallel connection combination are shown in FIG. 4, and the comparison results thereof are summarized in Table 1.

Table 1 shows liquefaction capacities of the series connection combination and the parallel connection combination, according to the number of cryocoolers. When two cryocoolers are used, the series connection combination liquefies a 10% larger amount of hydrogen than the parallel connection combination. As the number of cryocoolers used in each combination is increased, the difference in liquefaction capacity between two combinations increases. The reason will be described below. A cooler has higher liquefaction performance at a higher temperature. Therefore, an approach in which a first cooler deals with a higher temperature range and a second cooler deals with a lower temperature range produces a beneficial result in terms of an amount of gas that can be cooled. Moreover, the series connection combination is also highly superior to the parallel connection combination in terms of distribution of flow of hydrogen to be cooled. Accordingly, when applying a combination of multiple cryocoolers to a hydrogen liquefaction system to increase liquefaction capacity, the series connection combination is preferred to the parallel connection combination.

TABLE 1

| The number of cryocoolers (ea) | Series connection structure (L/h) | Parallel connection structure (L/h) | Gain of series connection to parallel connection (%) |
|---|---|---|---|
| 1 | 3.36 | 3.36 | 0 |
| 2 | 7.40 | 6.72 | 10.1 |
| 3 | 13.22 | 10.08 | 31.2 |
| 4 | 23.37 | 13.44 | 73.8 |

The small-scale hydrogen liquefaction system according to the present invention features a structure in which multiple cryocoolers 20 and 30 are connected in series with each other, thereby cooling and liquefying gaseous hydrogen through multiple cooling stages performed by the respective multiple cryocoolers 20 and 30.

According to the first embodiment of the present invention, the small-scale hydrogen liquefaction system includes: a first cryocooler 20 that primarily cools gaseous hydrogen, pre-cooled by the pre-cooling heat exchanger 10; and an n-th cryocooler 30 (last-stage cryocooler, wherein n is an integer equal to or greater than 2), which is connected in series with the first cryocooler 20 and further cools the gaseous hydrogen, primarily cooled by the first cryocooler 20, to a temperature of 20.3 K.

According to the first embodiment, the hydrogen liquefaction system includes two cryocoolers. Therefore, the n-th cryocooler 30 is a second cryocooler. The n-th cryocooler 30 is connected in series with the first cryocooler 20 and cools the gaseous hydrogen, primarily cooled by the first croycooler 20, to a liquefaction temperature of 20.3 K.

Meanwhile, the number of cryocoolers connected in series with each other can be increased so that the amount of gaseous hydrogen that is liquefied can be increased.

Figure 6:
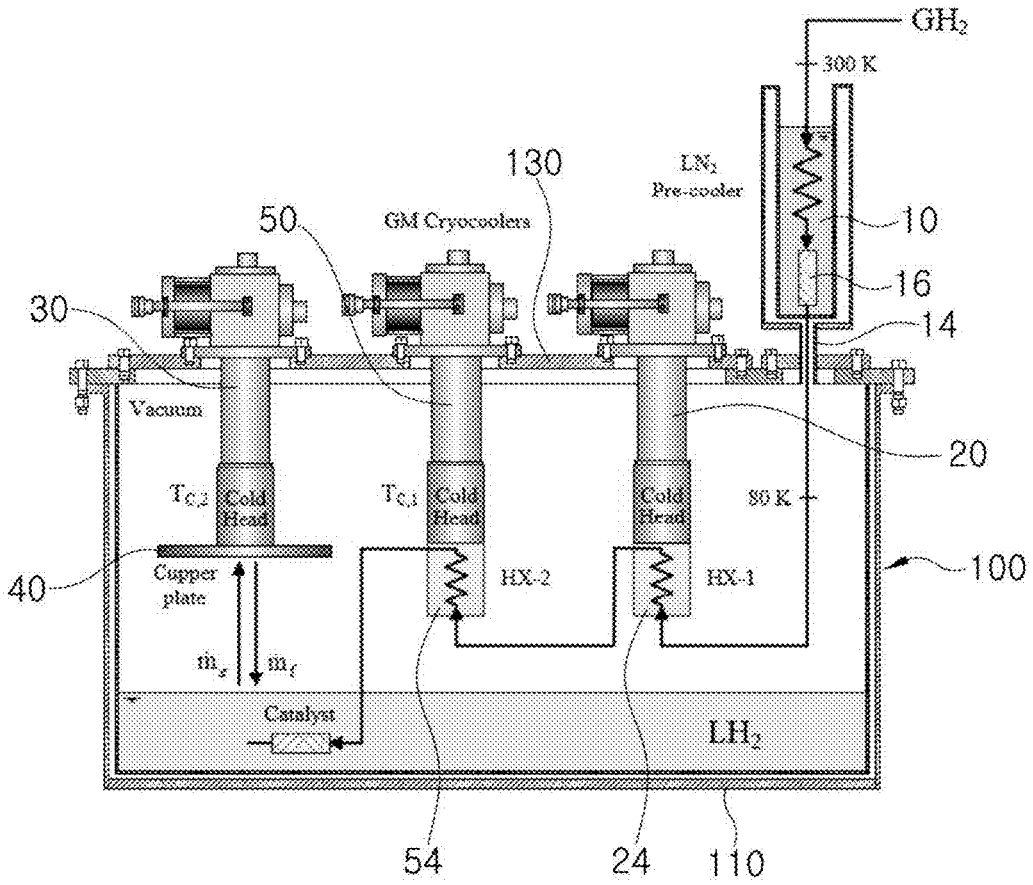
FIG. 6 is a diagram illustrating a small hydrogen liquefaction system according to a second embodiment of the present invention, in which three cryocoolers and a condensation plate are included.

According to a second embodiment of the present invention, as illustrated in FIG. 6, a hydrogen liquefaction system includes three cryocoolers 20, 30, and 50, and one condensation plate 40.

According to the second embodiment, the cryocooler 50 is arranged between the first cryocooler 20 and the n-th cryocooler 30. In this case, the n-th cryocooler 30 is a third cryocooler.

The cryocooler 50, which is additionally provided in comparison with the first embodiment, is connected in series with the first cryocooler 20 and functions as a second cryocooler that secondarily cools the gaseous hydrogen, which is primarily cooled by the first cryocooler 20.

The number of cryocoolers installed between the first cryocooler 20 and the n-th cryocooler 30 is not limited but is determined according to a target liquefaction capacity. That is, although the second embodiment uses three cryocoolers 20, 50, and 30 which are one more cryocooler than the first embodiment, the number of cryocoolers used in the present invention is not limited thereto. That is, when the last-stage cryocooler is the n-th cryocooler, n−1 cryocoolers can be added between the first cryocooler and the n-th cryocooler. In this case, the second to the n−1-th cryocoolers may be arranged between the first cryocooler 20 and the n-th cryocooler 20, thereby increasing the hydrogen liquefaction capacity.

In addition, heat exchangers 24 and 54 may be attached to cold heads of the first and second cryocoolers 20 and 50, respectively. The heat exchanger 24 connected to the first cryocooler 20 receives gaseous hydrogen, pre-cooled by the pre-cooling heat exchanger 10. Thus, gaseous hydrogen is further cooled by the cold head of the first cryocooler 20 and then discharged.

Figure 9:
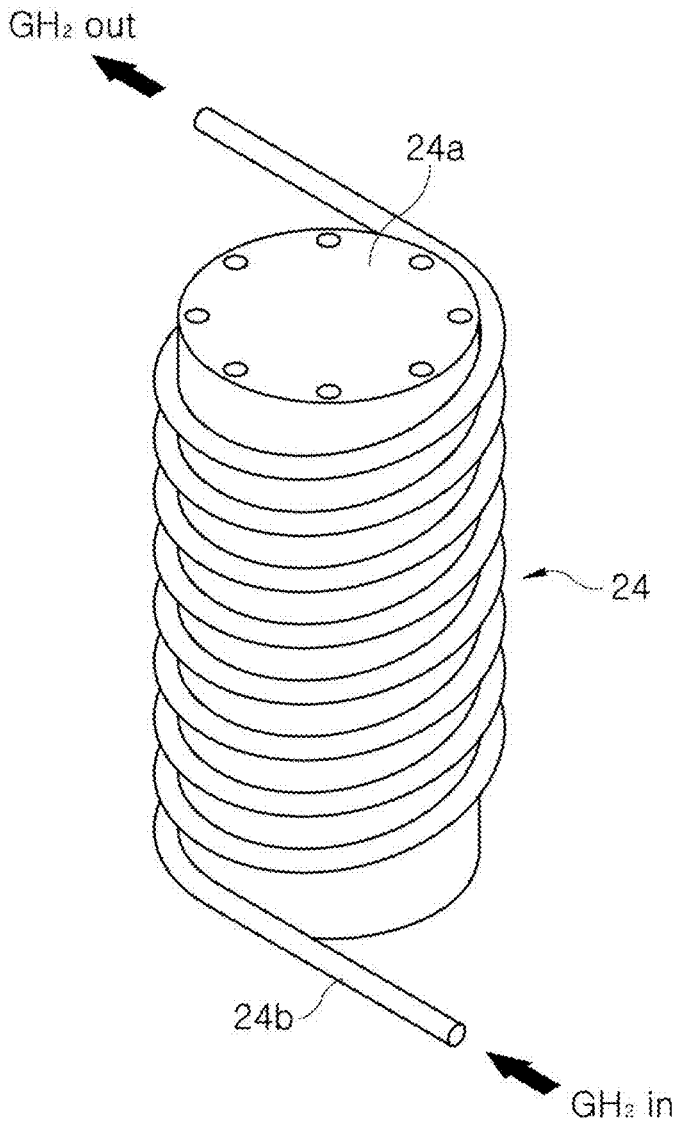
FIG. 9 is a perspective view illustrating a tube-cylinder heat exchanger TCHX used in a small-scale hydrogen liquefaction system according to either embodiment of the present invention.
Figure 10:
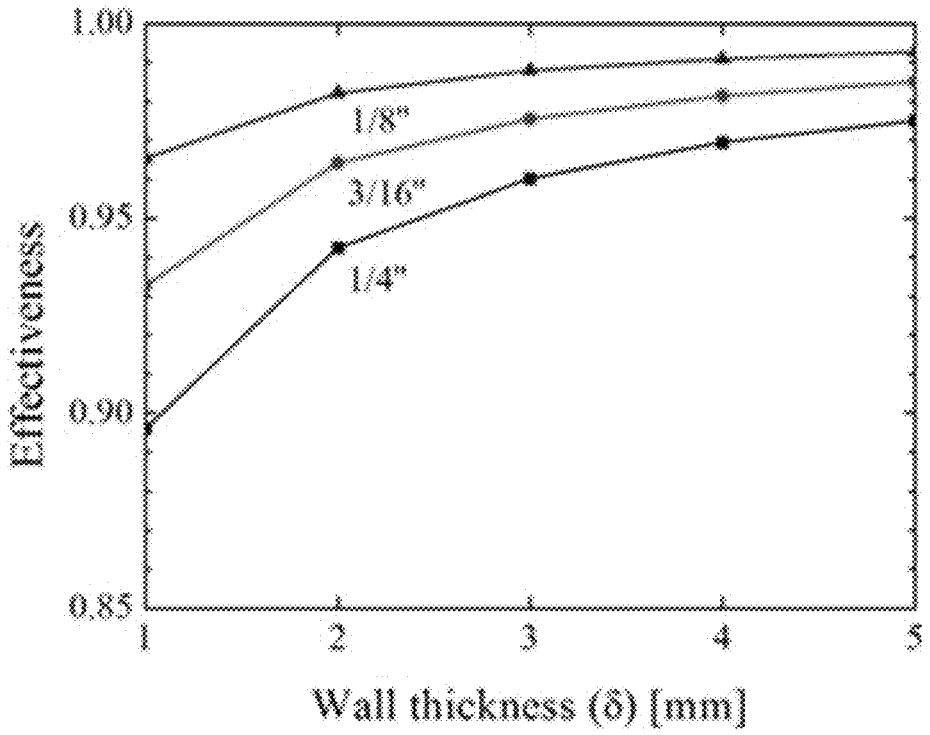
FIG. 10 is a diagram showing effectiveness of a heat exchanger according to wall thicknesses and diameters of a cylinder of a tube-cylinder heat exchanger according to the first embodiment of the present invention.
Figure 11:
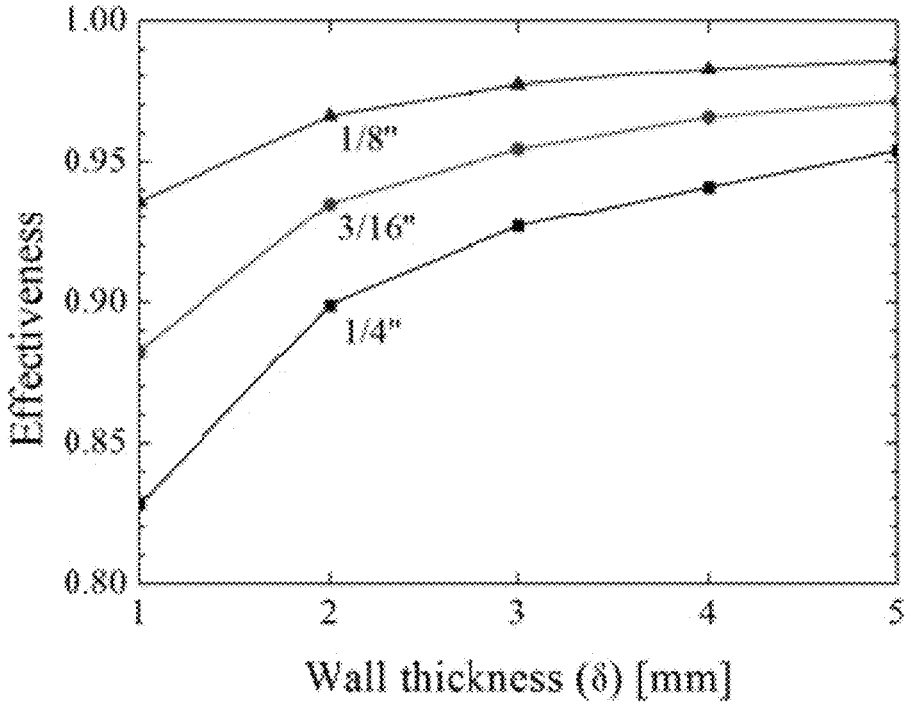
FIG. 11 is a diagram showing effectiveness of a heat exchanger according to wall thicknesses and diameters of a cylinder of a tube-cylinder heat exchanger according to the second embodiment of the present invention.

As illustrated in FIG. 9, the heat exchangers 24 and 54 each may be a tube-cylinder heat exchanger (TCHX) in which a tube 24*b* through which gaseous hydrogen flows is wound around the outer surface of a cylinder 24*a*.

The tube-cylinder heat exchanger (TCHX) has a simple structure and thus can be easily manufactured in comparison with other kinds of heat exchangers. Therefore, in the case of using the tube-cylinder heat exchanger (TCHX), it is possible to easily obtain a target exit temperature by adjusting the number of turns of the tube 24*b* and the length of the cylinder 24*a*. The tube-cylinder heat exchanger TCHX can be used for any type of heat exchange, for example, parallel-flow heat exchange, counter-flow heat exchange, and single-flow heat exchange. Especially, it is highly useful in a small-scale system. Therefore, it can be suitably used in the small-scale hydrogen liquefaction system according to the present invention.

In the tube-cylinder heat exchanger 24, tube-to-cylinder heat exchange as well as tube-to-tube heat exchange is performed. Therefore, a material of the tube-cylinder heat exchanger 24 is a very important design factor. As described above, in order to make the most of conductive cooling performed by the cold head, the tube 24*b* and the cylinder 24*a* are made of copper. The thermal conductivity of copper is 500 W/m-K or higher within a liquefaction temperature range of a small-scale hydrogen liquefaction system. That is, copper is a metal having the highest thermal conductivity among metals used at low temperatures.

Tube-cylinder heat exchanger (TCHX) can be easily replaced by various types of heat exchangers such as plate-type heat exchanger (PTHX) and porous foam heat exchanger (PFHX).

The number of tube-cylinder heat exchangers 24 may be two in a system having two cryocoolers but the number may be three in a system having three cryocoolers. Meanwhile, instead of the tube-cylinder heat exchanger, a brazed plate heat exchanger or other types of heat exchangers can be used.

The pre-cooling heat exchanger 10 pre-cools gaseous hydrogen by using liquid nitrogen.

It is not reasonable to cool gaseous hydrogen directly from 300 K to 20.3 K with only cryocoolers.

For this reason, the pre-cooling heat exchanger 10 is used to first pre-cool gaseous hydrogen to a temperature range of 77 to 80 K using liquid nitrogen. The pre-cooling heat exchanger 10 is structured such that a coil-shaped tube is dipped in a cylinder.

The pre-cooling heat exchanger 10 using liquid nitrogen cools gaseous hydrogen from 300 K to a temperature range of 77 to 80 K. The pre-cooling heat exchanger 10 includes a coil-shaped tube and an O-P catalytic converter 16.

In this case, preferably the pre-cooling heat exchanger 10 has the same diameter as the cryocoolers. The equidiameter of the pre-cooling heat exchanger 10 and the cryocooler enables a cryocooler to be installed in the same position at which the pre-cooling heat exchanger 10 is installed. That is, when the number of cryocoolers is increased from two to three, the pre-cooling heat exchanger 10 is removed and then an added cryocooler can be installed in the same position from which the pre-cooling heat exchanger 10 is removed.

According to the first embodiment in which two cryocoolers are used, the pre-cooling heat exchanger 10 is installed in the low-temperature chamber 100. Meanwhile, according to the second embodiment in which three cryocoolers are used, the pre-cooling heat exchanger 10 is installed outside the low-temperature chamber 100.

That is, in the case in which two cryocoolers are used, the pre-cooling heat exchanger 10 is directly attached to an upper plate 130 arranged at an upper end of the low-temperature chamber 100. On the other hand, in the second embodiment in which three cryocoolers are used, the pre-cooling heat exchanger 10 is installed on the upper plate 130 so as to be exposed outside. To facilitate this modification, an upper end and a lower end of the pre-cooling heat exchanger 10 may be provided with an upper flange 12 and a lower flange 14. As illustrated in FIG. 5, the upper flange 12 is used in the case in which a hydrogen liquefaction system includes only two cryocoolers. Meanwhile, as illustrated in FIG. 6, the lower flange 14 is used in the case in which the hydrogen liquefaction system includes three cryocoolers. In addition, preferably a gap between an outer wall and an inner wall of the pre-cooling heat exchanger 10 has a vacuum pressure, and the O-P catalytic converter 16 is installed in a pipe so that primary O-P conversion can be performed in the pipe.

In addition, a condensation plate 40 used to liquefy the gaseous hydrogen, cooled to the temperature of 20.3 K by the second cryocooler 30, is installed to be in contact with the second cryocooler 30.

The condensation plate 40 is a component to promote dropwise condensation by increasing a surface area for condensation. The condensation plate 40 is attached to the cold head 32 of the cryocooler, thereby performing conductive cooling. A heat transfer coefficient for dropwise condensation is dozens of times higher than a heat transfer coefficient for film condensation and thus an impact of overcooling is insignificant.

According to the present invention, the condensation plate 40 is used at the last stage, thereby obtaining a considerable cooling effect. The heat transfer surface at the last condensation stage is a critical factor in cooling. Since hydrogen gas condenses when coming into contact with a vertical wall, dropwise condensation or filmwise condensation may be performed according to the flow of liquid. Since dropwise condensation has a highly greater cooling effect than filmwise condensation due to high heat transfer efficiency, it is important to ensure dropwise condensation. For example, when the heat transfer surface is large and horizontally arranged, liquid droplets can effectively fall down and thus a dropwise condensation effect can be increased.

Accordingly, since liquid droplets are effectively formed and fall down due to the condensation plate 40 provided in the present invention, the dropwise condensation effect can be increased. In addition, it is preferable that the condensation plate 40 has a diameter as large as possible within a range permitted by the internal space.

When dropwise condensation occurs at the condensation plate 40, a covering material on the surface of the condensation plate offers thermal resistance. However, in the hydrogen liquefaction system according to the present invention, the thermal resistance is not significant. Therefore, it is a reasonable choice to attach the condensation plate 40 to the cryocooler that performs liquefaction instead of to the heat exchanger.

Figure 12:
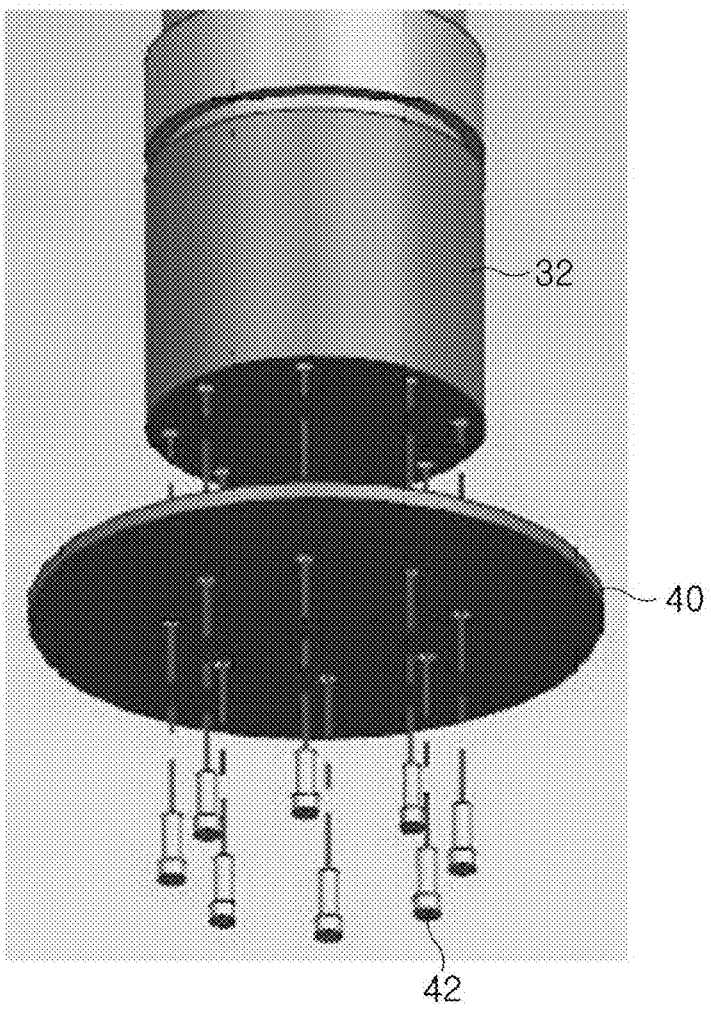
FIG. 12 is a perspective view illustrating an example in which a condensation plate is applied to a cold head in the present invention.

The condensation plate 40 is designed such that it can be attached to the cold head 32 using a bolt 32 as shown in FIG. 12.

On the other hand, the low-temperature chamber 100 provides an accommodation space to accommodate the pre-cooling heat exchanger 10, the first cryocooler 20, and the second cryocooler 30 therein. Specifically, the low-temperature chamber 100 includes an outer chamber 110 providing an accommodation space to accommodate the pre-cooling heat exchanger, the first cryocooler, and the n-th cryocooler, a liquefaction chamber 120 installed in the outer chamber 110 and containing liquid hydrogen liquefied by the condensation plate 40, and the upper plate 130 arranged at the upper end of the outer chamber 110 to fix the pre-cooling heat exchanger, the first cryocooler, and the n-th cryocooler.

Since the outer chamber 110 has a cylinder shape that is open at an upper end thereof, the liquefaction chamber 120 can be inserted through the opening. The opening at the upper end of the outer chamber 110 is closed by the upper plate 130 and thus the outer chamber 110 can be sealed.

In the low-temperature chamber 100, a gap formed between the outer chamber 110 and the liquefaction chamber 120 is filled with liquid nitrogen that functions to prevent external radiant heat from entering into the liquefaction chamber 120. The total heat load of each chamber is calculated by adding three kinds of incoming heats. Due to the intrusion of radiant heat through the outer wall and the inner wall of the low-temperature chamber 100, the heat load is increased in proportional to the surface area of the liquid chamber. Heat load attributable to radiant heat is mainly due to radiation through the outer wall. However, according to the present invention, a heat insulation effect can be greatly improved due to a double-insulation structure using liquid nitrogen filled between the outer wall and the inner wall.

A heat insulating system based on liquid nitrogen operates based on the principle that liquid nitrogen is used to prevent heat from entering into a hydrogen liquefaction system instead of liquid hydrogen. Thus, the liquid nitrogen prevents intrusion of heat corresponding to latent heat occurring in the process of vaporization. Therefore, the amount of liquid nitrogen that is needed in the heat insulating system has to be calculated. In addition, an electronic valve is provided to automatically control supply of the liquid nitrogen.

In addition, the upper plate 130 is designed such that the same upper plate can be used for the case in which the small-scale hydrogen liquefaction system includes two cryocoolers and also in the case in which the small-scale hydrogen liquefaction system includes three cryocoolers. In addition, the upper plate 130 also can be used in other cases in which the number of cryocoolers in the small-scale hydrogen liquefaction system is more than three. The upper plate 130 has a liquid hydrogen discharge hole (not shown in the drawings). When the small-scale hydrogen liquefaction system includes three cryocoolers, the upper plate 130 has a pre-cooling hydrogen gas supply hole through which hydrogen is supplied to the pre-cooling heat exchanger 10 and a cryocooler mounting unit to which a cryocooler is mounted.

Figure 7:
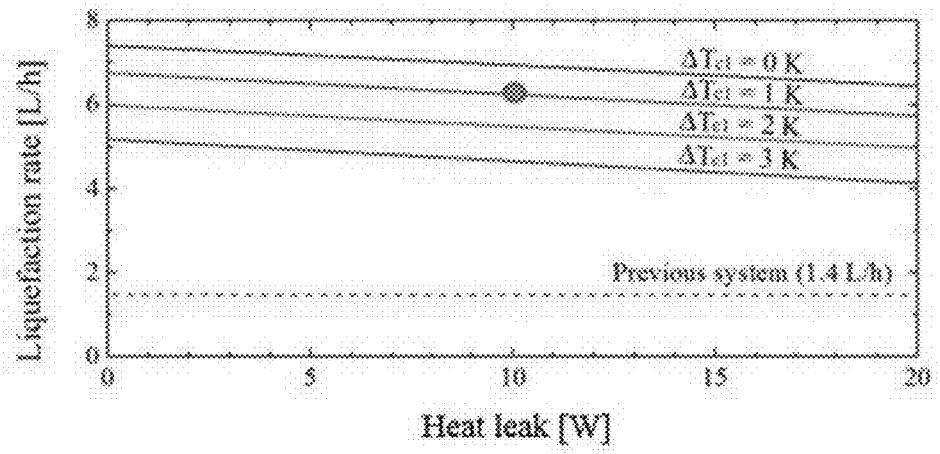
FIG. 7 is a graph illustrating liquefaction capacities according to heat loads and temperature differences between a cold head of a first cryocooler and a hydrogen gas.
Figure 8:
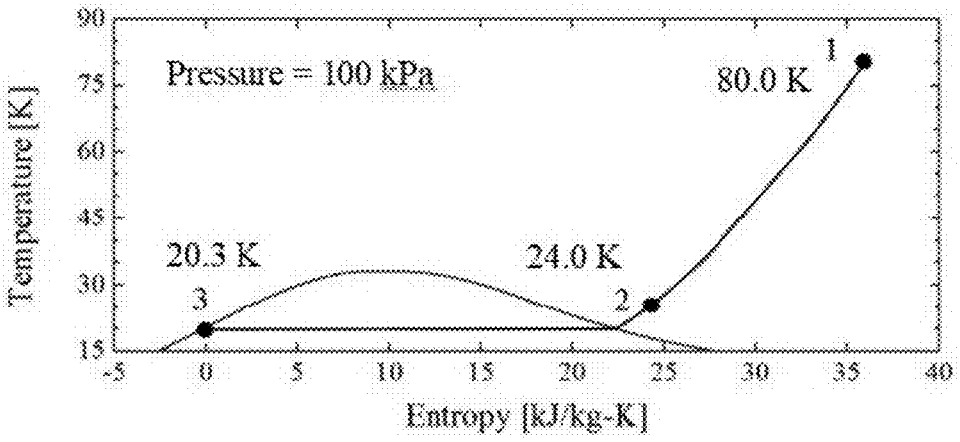
FIG. 8 is a T-s diagram of the small-scale hydrogen liquefaction system according to the first embodiment.

FIG. 7 is a graph illustrating liquefaction capacities according to heat loads and temperature differences between the cold head of the first cryocooler and hydrogen gas, and FIG. 8 is a T-s diagram of the small-scale hydrogen liquefaction system according to the first embodiment.

As described above, when the liquefaction capacity is predicted while changing the heat load and the temperature difference between the cold head of the first cryocooler and the hydrogen gas, the results of FIG. 7 are obtained. The effectiveness can be easily adjusted by changing designs of the heat exchangers used, and the effectiveness is preferably fixed to 0.95. The T-s diagram of the hydrogen liquefaction system according to the first embodiment is shown in FIG. 8. In this case, the liquefaction capacity meets the target liquefaction capacity of 6.25 L/h. The temperatures of the cold heads of the first and second cryocoolers are maintained at 21.0 K and 19.3 K either of which is lower than the temperature of the hydrogen.

In addition, a temperature sensor (not shown) may be attached to the hold head of the first cryocooler or the n-th cryocooler to detect the level of the liquid hydrogen in the liquefaction chamber 120 and to determine stop timing of the hydrogen liquefaction system.

In addition, a vertical bar (not shown) may be installed at the bottom of the first cryocooler 20 or the n-th cryocooler to detect the level of the liquid hydrogen. In this case, in addition, a plurality of temperature sensors may be arranged at regular intervals on the surface of the vertical bar.

A liquefaction process performed by the small-scale hydrogen liquefaction system according to the present invention will be described below.

Gaseous hydrogen at a room temperature of 300 K is first cooled down to about a nitrogen liquefaction temperature of 77 K by the pre-cooling heat exchanger 10. In the case of the first embodiment in which two cryocoolers are used, the pre-cooled gaseous hydrogen is introduced into the tube-cylinder heat exchanger 24 through the first catalytic converter 16. The gaseous hydrogen that passes through the tube-cylinder heat exchanger 24 is then introduced into a tank. At this point, when the tank is full of liquid hydrogen, the gaseous hydrogen rises as hydrogen bubbles.

The hydrogen gas is then dropwise-condensed by the condensation plate 40 assembled with the second cryocooler, and then the resultant liquid hydrogen falls to the bottom of the tank. At this point, there is a probability that the liquid hydrogen evaporates due to externally introduced heat. The evaporated hydrogen is condensed again by coming into contact the condensation plate 40 and is then collected in the tank.

In the case of the second embodiment in which three cryocoolers are used, almost the entire process is similar to the first embodiment except for the gaseous hydrogen passes through two tube-cylinder heat exchanger 24 and 54 instead of one tube-cylinder heat exchanger, resulting in an increase in liquefaction capacity compared to the first embodiment.

Figure 13:
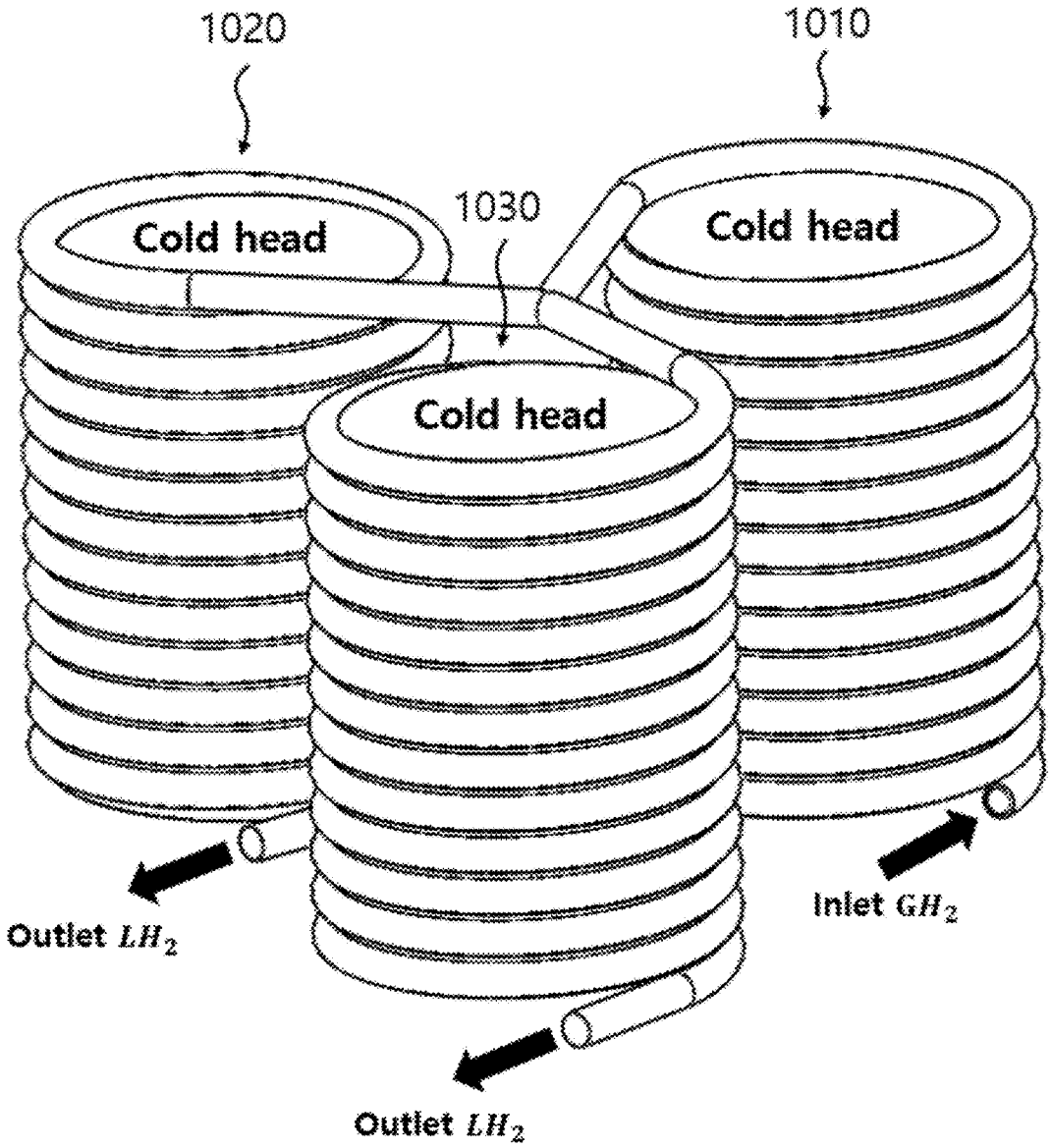
FIG. 13 is a diagram illustrating a small-scale hydrogen liquefaction system according to a third embodiment of the present invention, in which three cryocoolers are included.

FIG. 13 is a diagram illustrating a small-scale hydrogen liquefaction system according to a third embodiment of the present invention. FIG. 13 only shows a connecting structure of the cryocoolers, and elements, not shown in FIG. 13 and described above regarding the first and second embodiments, are also applicable to the third embodiment.

Referring to FIG. 13, the small-scale hydrogen liquefaction system according to the third embodiment includes the cryocoolers 1010, 1020 and 1030.

A gaseous hydrogen, pre-cooled by the pre-cooling heat exchanger (not shown in FIG. 13 and e.g. 10 in FIGS. 5 and 6), is supplied into the cryocooler 1010.

The gaseous hydrogen, having flowed through the cryocooler 1010, is divided into two portions and the two portions flows into the cryocoolers 1020 and 1030. The two portions of the gaseous hydrogen change into a liquid state in the cryocoolers 1020 and 1030 and the two portions of the gaseous in the liquid state flows out of the cryocoolers 1020 and 1030.

Each of three heat exchangers (not shown in FIG. 13 and e. g. 24 or 54 in FIGS. 5 and 6) may be attached to a cold head of each of the cryocoolers 1010, 1020 and 1030. Alternately, two condensation plate (not shown in FIG. 13 and e.g. 40 in FIGS. 5 and 6) may be arranged to be in contact with the parallel-connected cryocoolers 1020 and 1030, and one heat exchanger may be attached to a cold head of the cryocooler 1010.

FIG. 13 shows only one cryocooler 1010, which is connected the cryocoolers 1020 and 1030 connected in parallel. However, the scope of this invention is not limited thereto, and two or more cryocoolers, which are connected in series, e.g. as shown in FIGS. 5 and 6, may be connected to the parallel-connected cryocoolers 1020 and 1030, instead of the single cryocooler 1010. The series-connected cryocoolers has m cryocoolers having a first cryocooler to a m-th cryocooler such that a gaseous hydrogen, which may be pre-cooled by the pre-cooling heat exchanger, sequentially flows from the first cryocooler to the m-th cryocooler. The gaseous hydrogen outputted from the m-th cryocooler may be divided and flows each of the cryocoolers 1020 and 1030 connected in parallel. In this case, m heat exchangers may be attached to cold heads of the serially-connected m cryocoolers, respectively.

Additionally, FIG. 13 shows two parallel-connected cryocoolers 1020 and 1030. However, three or more parallel-connected cryocoolers may be connected to the cryocooler 1010. In this case, the same number of the condensation plates as the parallel-connected cryocoolers may be arranged to be in contact with the parallel-connected cryocoolers, respectively.

Further, each of three or more parallel-connected cryocoolers may be connected to the m-th cryocoolers, which is last connected among the m series-connected cryocoolers. In this case, m heat exchangers may be attached to cold heads of the serially-connected m cryocoolers, respectively, and the same number of the condensation plates as the parallel-connected cryocoolers may be arranged to be in contact with the parallel-connected cryocoolers, respectively.

A small-scale hydrogen liquefaction system according to an embodiment of the present invention has large liquefaction capacity by employing multiple cryocoolers.

In addition, according to an embodiment of the present invention, the small-scale hydrogen liquefaction system has multiple cryocoolers connected in series with each other, thereby liquefying hydrogen at a liquefaction rate of 10 L/h.

In addition, according to an embodiment of the present invention, since the small-scale hydrogen liquefaction system is constructed using commercially available cryocoolers, it is possible to reduce initial investment costs, simplify the structure, and guarantee safety.

In addition, according to an embodiment of the present invention, since liquid nitrogen is used for production of a small volume of liquid hydrogen, operation costs are reduced in comparison with a method of using expensive liquid helium, and an exhaust gas can be properly treated.

The scope of the present invention is not limited to the preferred embodiments described about but defined by the accompanying claims. Moreover, those skilled in the art will appreciate that various modifications, additions and substitutions are possible, without departing from the scope and spirit of the invention as disclosed in the accompanying claims.

What is claimed is:

1. A small-scale hydrogen liquefaction system employing multiple cryocoolers to liquefy gaseous hydrogen through multiple cooling stages, the system comprising:

a gas supply line to supply a gaseous hydrogen;

n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 2;

n heat exchangers each attached to a cold head of each of the n cryocoolers;

m cryocoolers having the first cryocooler to m-th cryocooler and connected between the gas supply line and the n cryocoolers, wherein m is a natural number equal to or greater than 1; and a low-temperature chamber providing an accommodation space to accommodate the n cryocoolers and the m cryocoolers therein, and wherein the m cryocoolers are sequentially connected in series from the first cryocooler to the m-th cryocooler and configured such that the gaseous hydrogen supplied from the gas supply line sequentially flows through the first cryocooler to the m-th cryocooler and the gaseous hydrogen outputted from the m-th cryocooler is divided and supplied to each of the n cryocoolers.

2. The small-scale hydrogen liquefaction system according to claim 1, further comprising:

a pre-cooling heat exchanger for pre-cooling the gaseous hydrogen supplied from the gas supply line, using liquid nitrogen, wherein the pre-cooling heat exchanger is connected between the gas supply line and the n cryocoolers and is configured to provide the pre-cooled gaseous hydrogen to each of the n cryocoolers.

3. The small-scale hydrogen liquefaction system according to claim 1, wherein each of the n cryocoolers is a single-stage cryocooler having one expansion stage.

4. A small-scale hydrogen liquefaction system employing multiple cryocoolers to liquefy gaseous hydrogen through multiple cooling stages, the system comprising:

a gas supply line to supply a gaseous hydrogen;

n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 2;

n heat exchangers each attached to a cold head of each of the n cryocoolers; and a low-temperature chamber providing an accommodation space to accommodate the n cryocoolers therein, wherein the heat exchangers attached to the respective cold heads each are a tube-cylinder heat exchanger (TCHX) in which a tube through which gaseous hydrogen flows is wound around an outer surface of a cylinder.

5. A small-scale hydrogen liquefaction system employing multiple cryocoolers to liquefy gaseous hydrogen through multiple cooling stages, the system comprising:

a gas supply line to supply a gaseous hydrogen;

n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 3;

n heat exchangers each attached to a cold head of each of the n cryocoolers; and a low-temperature chamber providing an accommodation space to accommodate the n cryocoolers therein, wherein the low-temperature chamber includes:

an outer chamber providing an accommodation space to accommodate the pre-cooling heat exchanger and the n cryocoolers therein;

a liquefaction chamber installed in the outer chamber and containing liquid hydrogen liquefied by the condensation plates; and an upper plate installed at an upper end of the outer chamber and fixing the pre-cooling heat exchanger and the n cryocoolers.

6. The small-scale hydrogen liquefaction system according to claim 5, wherein in the low-temperature chamber, a gap between the outer chamber and the liquefaction chamber is filled with liquid nitrogen functioning to hinder intrusion of radiant heat.

7. The small-scale hydrogen liquefaction system according to claim 5, wherein the upper plate is designed to be used without any change whether the number of cryocoolers is two or three, and wherein the upper plate is provided with an exhaust gas hole, a pre-cooling gaseous hydrogen gas supply hole, and a cryocooler mounting unit.

8. The small-scale hydrogen liquefaction system according to claim 5, wherein the pre-cooling heat exchanger is structured such that a coil-shaped tube is dipped in a cylindrical chamber; and wherein the pre-cooling heat exchanger is directly attached to the upper plate of the outer chamber or attached via flanges provided to an upper end and a lower end of the pre-cooling heat exchanger such that the pre-cooling heat exchanger is exposed on the upper plate.

9. A small-scale hydrogen liquefaction system employing multiple cryocoolers to liquefy gaseous hydrogen through multiple cooling stages, the system comprising:

a gas supply line to supply a gaseous hydrogen;

n cryocoolers each connected to the gas supply line to be connected in parallel and configured such that the gaseous hydrogen supplied from the gas supply line is divided into n portions, and the n portions flow through the n cryocoolers, respectively, and are cooled to a liquefaction temperature, wherein n is a natural number equal to or greater than 2;

n heat exchangers each attached to a cold head of each of the n cryocoolers;

a low-temperature chamber providing an accommodation space to accommodate the n cryocoolers therein;

a vertical bar installed at a lower end of at least one of the n cryocoolers; and a plurality of temperature sensors arranged at regular intervals on a surface of the vertical bar to detect a level of liquid hydrogen in the liquefaction chamber and to determine stop timing of the hydrogen liquefaction system.

10. A small-scale hydrogen liquefaction system employing multiple cryocoolers to liquefy gaseous hydrogen through multiple cooling stages, the system comprising:

a gas supply line to supply a gaseous hydrogen;

n cryocoolers each connected to the gas supply line to be connected in parallel with each other and configured such that the gaseous hydrogen supplied from the gas supply line is divided into n portions, and the n portions flow through the n cryocoolers, respectively and are cooled to a liquefaction temperature, wherein n is a natural number equal to or greater than 2;

n condensation plates arranged to be in contact with the n cryocoolers, respectively, to liquefy the gaseous hydrogen, the n portions of which are cooled to the liquefaction temperature by the n cryocoolers, respectively; and a low-temperature chamber providing an accommodation space to accommodate the n cryocoolers therein.

11. The small-scale hydrogen liquefaction system according to claim 10, further comprising:

a pre-cooling heat exchanger for pre-cooling the gaseous hydrogen supplied from the gas supply line, using liquid nitrogen, wherein the pre-cooling heat exchanger is connected between the gas supply line and the n cryocoolers and is configured to provide the pre-cooled gaseous hydrogen to each of the n cryocoolers.

12. The small-scale hydrogen liquefaction system according to claim 10, further comprising m cryocoolers having the first cryocooler to m-th cryocooler and connected between the gas supply line and the n cryocoolers, wherein m is a natural number equal to or greater than 1, wherein the m cryocoolers are sequentially connected in series from the first cryocooler to the m-th cryocooler and configured such that the gaseous hydrogen supplied from the gas supply line sequentially flows through the first cryocooler to the m-th cryocooler and the gaseous hydrogen outputted from the m-th cryocooler is divided and supplied to each of the n cryocoolers.

13. The small-scale hydrogen liquefaction system according to claim 12, further comprising:

m heat exchangers each attached to a cold head of each of the first cryocooler to the m-th cryocooler.

14. The small-scale hydrogen liquefaction system according to claim 13, wherein the heat exchangers attached to the respective cold heads each are a tube-cylinder heat exchanger (TCHX) in which a tube through which gaseous hydrogen flows is wound around an outer surface of a cylinder.

* * * * *